US006302083B1

(12) United States Patent
Kärcher et al.

(10) Patent No.: US 6,302,083 B1
(45) Date of Patent: Oct. 16, 2001

(54) METHOD FOR CYLINDER EQUALIZATION IN AN INTERNAL COMBUSTION ENGINE OPERATING BY DIRECT INJECTION

(75) Inventors: Andreas Kärcher, Weingarten; Achim Przymusinski, Regensburg; Ralf Schernewski, Karlsruhe, all of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/677,562

(22) Filed: Oct. 2, 2000

Related U.S. Application Data

(63) Continuation of application No. PCT/DE99/00654, filed on Mar. 10, 1999.

(30) Foreign Application Priority Data

Mar. 30, 1998 (DE) ..... 198 14 155

(51) Int. Cl.[7] ..... F02D 41/40
(52) U.S. Cl. ..... 123/305; 123/436
(58) Field of Search ..... 123/305, 436; 701/104, 110, 111; 73/116

(56) References Cited

U.S. PATENT DOCUMENTS 4,705,000 11/1987 Matsumura et al. ..... 123/357
6,082,187 * 7/2000 Schricker et al. ..... 123/436

FOREIGN PATENT DOCUMENTS 41 22 139 A1 1/1993 (DE) .
196 27 540 A1 8/1997 (DE) .
197 13 104 A1 10/1997 (DE) .
198 12 305-A1 * 9/1999 (DE) ..... F02D/41/38

* cited by examiner

*Primary Examiner*—Andrew M. Dolinar
(74) *Attorney, Agent, or Firm*—Herbert L. Lerner; Laurence A. Greenberg; Werner H. Stemer

(57) ABSTRACT

The values for the speed of the crankshaft are corrected by means of an acausal mean-value filter, and the change in the kinetic energy of the crankshaft in the expansion interval of a cylinder is calculated from the dynamically corrected speed values and referred to the maximum fuel quantity which can be fed in this interval. The dimensionless residue obtained therefrom represents for the cylinder under consideration a measure of too much or too little injected fuel. Correction terms are derived from the calculated residues for the injection times of the individual cylinders. This renders adaptation possible in the overall region of the characteristic diagram, in particular also in the case of speed transitions.

8 Claims, 6 Drawing Sheets n [1/min]
1240
1220
1200
1180
1160
1140
Zyl. i
Zyl. i + 1
before ignition
n(OT(i))
after ignition
n(UT(i))
0.02
0.04
0.06
0.08
0.1
0.12
0.14
t [s]

n [1/min]
1240
1220
1200
1180
1160
1140
Zyl. i
Zyl. i + 1
before ignition
n(OT(i))
after ignition
n(UT(i))
0.02
0.04
0.06
0.08
0.1
0.12
0.14
t [s]

METHOD FOR CYLINDER EQUALIZATION IN AN INTERNAL COMBUSTION ENGINE OPERATING BY DIRECT INJECTION

CROSS-REFERENCE TO RELATED APPLICATION

This is a continuation of copending international application PCT/DE99/00654, filed Mar. 10, 1999, which designated the United States.

BACKGROUND OF THE INVENTION

Field of the Invention

The invention relates to a method for cylinder equalization in an internal combustion engine operating by direct injection.

In the case of multi-cylinder, direct-injection internal combustion engines, different interfering influences cause high variances in the mass rate of flow occur between individual injection nozzles despite identical driving. The different fuel quantities lead to different torque contributions of the individual cylinders. And, in addition to aggravating the lack of smooth running through speed fluctuations in the crankshaft, emissions increase.

U.S. Pat. No. 5,385,129 (See DE 41 22 139 A1) discloses a method for cylinder equalization with reference to the fuel injection quantities in the case of an internal combustion engine, in the case of which the angular acceleration of each individual cylinder is detected. The individual measured values of the angular acceleration are intercompared, and in the case of deviations between the individual measured values the fuel injection quantities of the individual cylinders are varied such that deviations are finally avoided and cyclic irregularities in the internal combustion engine are thereby eliminated.

SUMMARY OF THE INVENTION

It is accordingly an object of the invention to provide a method for cylinder equalization in an internal combustion engine operating by direct injection that overcomes the before-mentioned disadvantages of the heretofore-known devices of this general type and that specifies a method to compensate simply and rapidly the systematic error in the individual injection nozzles of the injection system both in the case of stationary and in the case of nonstationary operation of the internal combustion engine.

With the foregoing and other objects in view, there is provided, in accordance with the invention, a method for cylinder equalization having the following steps. Providing an internal combustion engine having a crank shaft and cylinders operating by direct injection, each cylinder having a fuel injection quantity. Detecting a speed value of the crankshaft in a quasi-stationary and in a dynamic operating state of the internal combustion engine. Correcting the speed values with a mean-value filter having an envelope delay of zero to form a corrected speed value. Calculating a change in the kinetic energy of the crankshaft in an expansion interval of a cylinder from the corrected speed value. Deriving from the change in kinetic energy of the crankshaft a relative measure for each cylinder that contains information on too much or too little injected fuel quantity. Calculating correction terms for the injection time from this measure. And, changing each cylinder-specific injection time by applying a respective cylinder-specific correction term so that the internal combustion engine runs more smoothly.

In accordance with another feature of the invention, the correction of the speed values is performed according to the following relationship:

$$\hat{n}_{OT(i+1)} = n_{OT(i+1)} - \frac{\bar{n}_{OT(i+1)} - \bar{n}_{OT(i)}}{2}$$

$$\hat{n}_{OT(i)} = n_{OT(i)} - \frac{\bar{n}_{OT(i+1)} - \bar{n}_{OT(i)}}{2}$$

where $$\hat{n}_{OT(i)}, \hat{n}_{OT(i+1)}$$

is the corrected speed of the cylinder i and i+1, respectively, over a working cycle, and $$\bar{n}_{OT(i)}, \bar{n}_{OT(i+1)}$$

is the mean value of the speed of the cylinder i and i+1, respectively, over a working cycle.

In accordance with another feature of the invention, the internal combustion engine is a 4-cylinder internal combustion engine and the mean value of the cylinder is calculated as:

$$\bar{n}_{OT(i)} = \tfrac{1}{8} n_{OT(i-2)} + \tfrac{1}{4} n_{OT(i-1)} + \tfrac{1}{4} n_{OT(i)} + \tfrac{1}{4} n_{OT(i+1)} + \tfrac{1}{8} n_{OT(i+2)}$$

In accordance with another feature of the invention, the internal combustion engine is a 4-cylinder internal combustion engine and the mean value of the cylinder is calculated as:

$$\bar{n}_{OT(i+1)} = \tfrac{1}{8} n_{OT(i-1)} + \tfrac{1}{4} n_{OT(1)} + \tfrac{1}{4} n_{OT(i+1)} + \tfrac{1}{4} n_{OT(i+2)} + \tfrac{1}{8} n_{OT(i+3)}$$

In accordance with another feature of the invention, the change in the kinetic energy are referred to a value which specifies a maximum fuel energy which can be fed in an interval, and the relative measure is calculated therefrom.

In accordance with another feature of the invention, the change in the kinetic energy is calculated in accordance with the following equation $$\Delta E_{kin}(i) = \tfrac{1}{2} \cdot \Theta \cdot (\hat{n}_{OT(i+1)}^2 - \hat{n}_{OT(i)}^2)$$

and the measure is determined therefrom as $$R_{Z(i)} = K_{norm} \cdot (\hat{n}_{OT(k,i+1)}^2 - \hat{n}_{OT(k,i)}^2)$$

where $\Theta$ is the mean moment of inertia of the crankshaft, $H_u$ is the lower calorific value for the fuel used, $m_{Bmax}$ is the maximum injectable fuel quantity, $\hat{n}_{OT(i)}$ is the corrected speed at the top dead center of the cylinder i, $\hat{n}_{OT(i+1)}$ is the corrected speed at the top dead center of the cylinder i+1, and $K_{norm}$ is a normalizing factor which has the value of $$\frac{\Theta}{2} \cdot \frac{1}{H_u m_{B\max}} \left(\frac{2\pi}{60}\right)^2.$$

In accordance with another feature of the invention, the correction terms by which the values for the injection times are multiplied are calculated from the calculated measures.

In accordance with another feature of the invention, the correction terms are calculated as $$\begin{bmatrix}\delta_{Z(1),k}\\ \delta_{Z(2),k}\\ \delta_{Z(3),k}\\ \delta_{Z(4),k}\end{bmatrix}=\begin{bmatrix}\delta_{Z(1),k-1}\\ \delta_{Z(2),k-1}\\ \delta_{Z(3),k-1}\\ \delta_{Z(4),k-1}\end{bmatrix}+\alpha\cdot\left[-\begin{pmatrix}R_{Z(1),k}\\ R_{Z(2),k}\\ R_{Z(3),k}\\ R_{Z(4),k}\end{pmatrix}+\frac{1}{3}\cdot\begin{pmatrix}R_{Z(2),k}+R_{Z(3),k}+R_{Z(4),k}\\ R_{Z(3),k}+R_{Z(4),k}+R_{Z(1),k}\\ R_{Z(4),k}+R_{Z(1),k}+R_{Z(2),k}\\ R_{Z(1),k}+R_{Z(2),k}+RZ_{(3),k}\end{pmatrix}\right]$$

$$\text{with}\begin{bmatrix}\delta_{Z(1),0}\\ \delta_{Z(2),0}\\ \delta_{Z(3),0}\\ \delta_{Z(4),0}\end{bmatrix}=\begin{bmatrix}1\\ 1\\ 1\\ 1\end{bmatrix}$$

as an initialization value, and where $\delta_{Z(i),k}$ is the correction term for cylinder i after adaptation step k, $R_{Z(i),k}$ is the residue of the cylinder i relative to the adaptation step k, and $\alpha$ is a positive, freely selectable adaptation parameter between 0 and 1 which fixes the rate of the adaptation.

The energy released by the combustion in the individual cylinders is converted into kinetic energy of the crankshaft. Cylinder-specific combustion differences are therefore seen in speed fluctuations from which an error can be determined. This cylinder-specific error signal is characteristic of the systematic error in the injection operation in the cylinder. The method excludes faulty adaptations even during nonstationary operation of the internal combustion engine. For example, in the case of acceleration, the characteristic values (i.e., the speed values detected by the speed sensor) are dynamically corrected using an acausal filter. This dynamic correction can determine an error even in the case of speed transitions, and adapt in the overall region of the characteristic diagram. The method uses the crankshaft speed fed to the control device of the internal combustion engine as input variable. In any case, the crankshaft speed is fed to the control device of the internal combustion engine for other control and regulation purposes. Consequently, no additional hardware components are required to enhance the smooth running of the internal combustion engine. This makes the method very cost effective.

Other features which are considered as characteristic for the invention are set forth in the appended claims.

Although the invention is illustrated and described herein as embodied in a method for cylinder equalization in an internal combustion engine operating by direct injection, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

In order to be able to correct a possible deviation in the actually injected fuel quantity from the desired injection quantity, a measure of this deviation, that is to say an error, must be determined. The signal of a speed sensor is used to measure this deviation. The energy released in the individual cylinders by the combustion is converted into kinetic energy of the crankshaft. Cylinder-specific combustion differences are therefore expressed in speed fluctuations from which an error can be determined. The kinetic energy which is released during the combustion in a cylinder i is calculated as $$\Delta E_{kin}(i)=\tfrac{1}{2}\cdot\theta\cdot(\omega_{UT(i)}^2-\omega_{OT(i)}^2) \quad (1)$$

where $\theta$ is the mean moment of inertia of the crankshaft, $\omega_{OT(i)}$ is the angular velocity at the top dead center (before the expansion phase), and $\omega_{UT(i)}$ is the angular velocity at the bottom dead center (after the expansion phase).

The bottom dead center (index UT) of the cylinder i corresponds, however, to the top dead center (index OT) of the cylinder i+1 ignited as the next one. Consequently, this equation can also be specified in the following way:

$$\Delta E_{kin}(i)=\tfrac{1}{2}\cdot\theta\cdot(\omega_{OT(i+1)}^2-\omega_{OT(i)}^2) \quad (2)$$

A positive change in the kinetic energy ($\Delta E_{kin}(i)>0$) corresponds to an excessively large injection quantity $m_{B,i}$ of fuel, and a negative change in the kinetic energy ($\Delta E_{kin}(i)<0$) corresponds to an excessively small injection quantity $m_{B,i}$. If $\Delta E_{kin}(i)=0$, the correct fuel quantity was injected.

However, these statements apply only when it is possible to assume a quasi-stationary operating state (in which case the mean speed remains constant) and the load torque has no discontinuities.

Figure 1B:
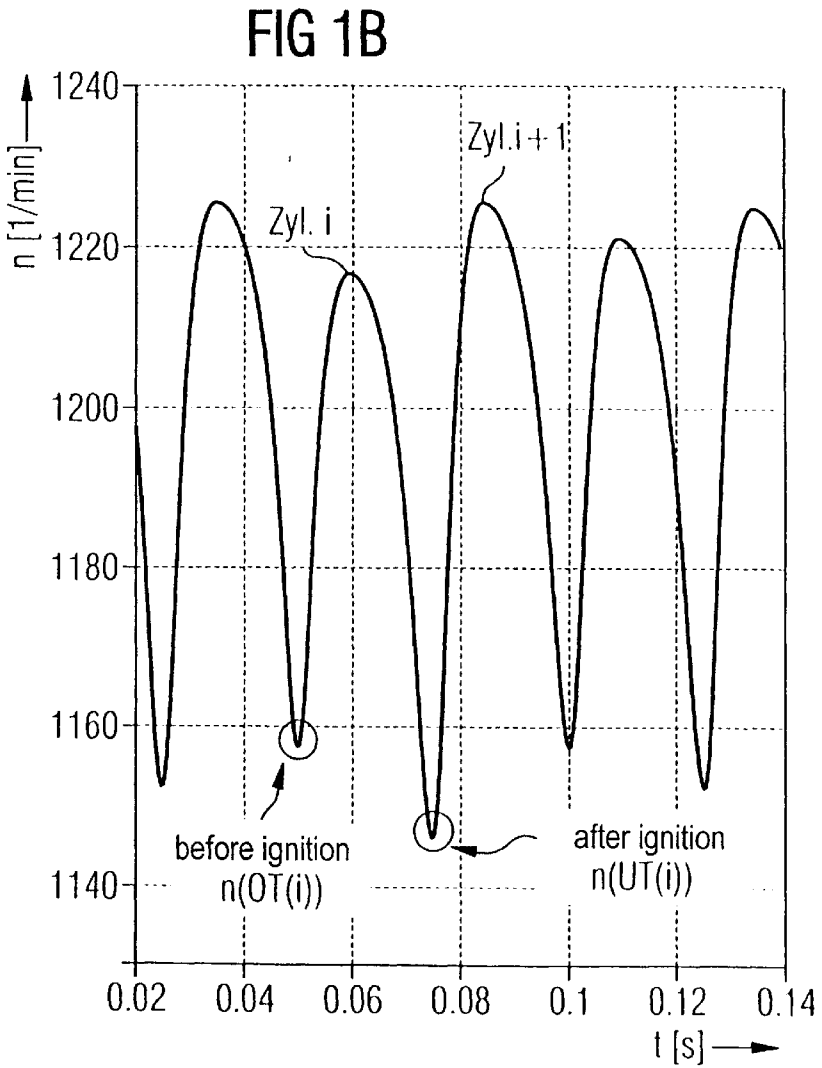
FIG. 1B is a graph plotting speed n versus time t for faulty injectors in stationary operation.
Figure 1A:
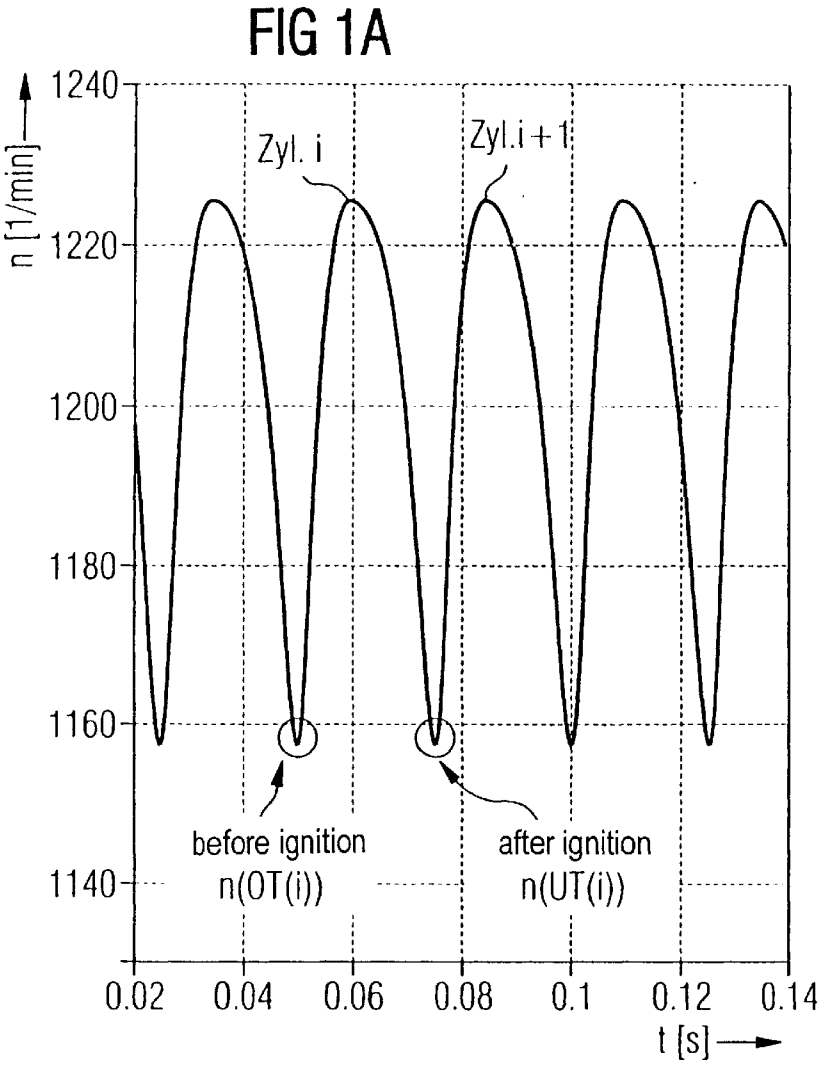
FIG. 1A is a graph plotting speed n versus time t for satisfactory injectors in stationary operation.

The characteristic of the speed n is plotted against time t for satisfactory injectors in FIG. 1A, and the speed characteristic is plotted against time for faulty injectors in FIG. 1B, in each case for the stationary operation of the internal combustion engine. In both cases, the cylinder-specific signal values, to be precise the speeds before the ignition n(OT(i)) and after the ignition n(UT(i)) for the cylinder i, are marked in the form of circles.

The angular velocity $\omega$, and thus also $\Delta E_{kin}$, can be calculated from the speed n by simple conversion.

If the method is also applied when the internal combustion engine is not in stationary operation, it is impossible to make any statements on the faults of the injectors. If, for example, the internal combustion engine is undergoing acceleration, an error may be detected when none is present.

Figure 2A:
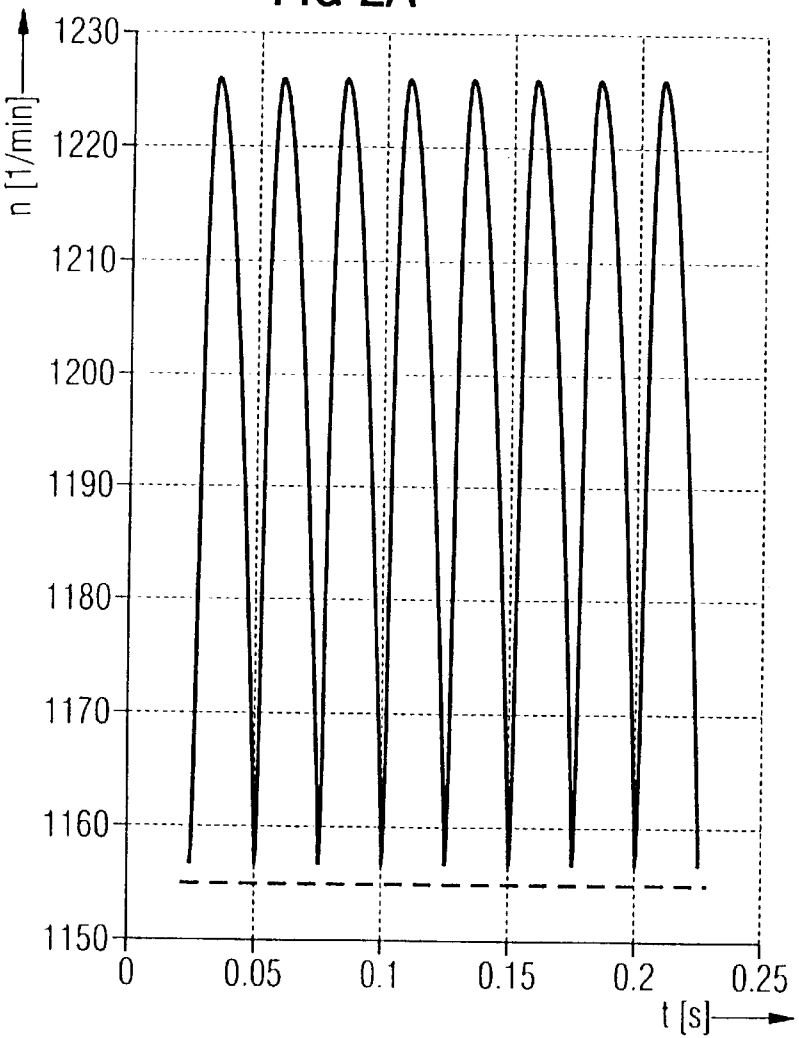
FIG. 2A is a graph plotting speed n versus time t for satisfactory injectors in stationary operation.
Figure 2B:
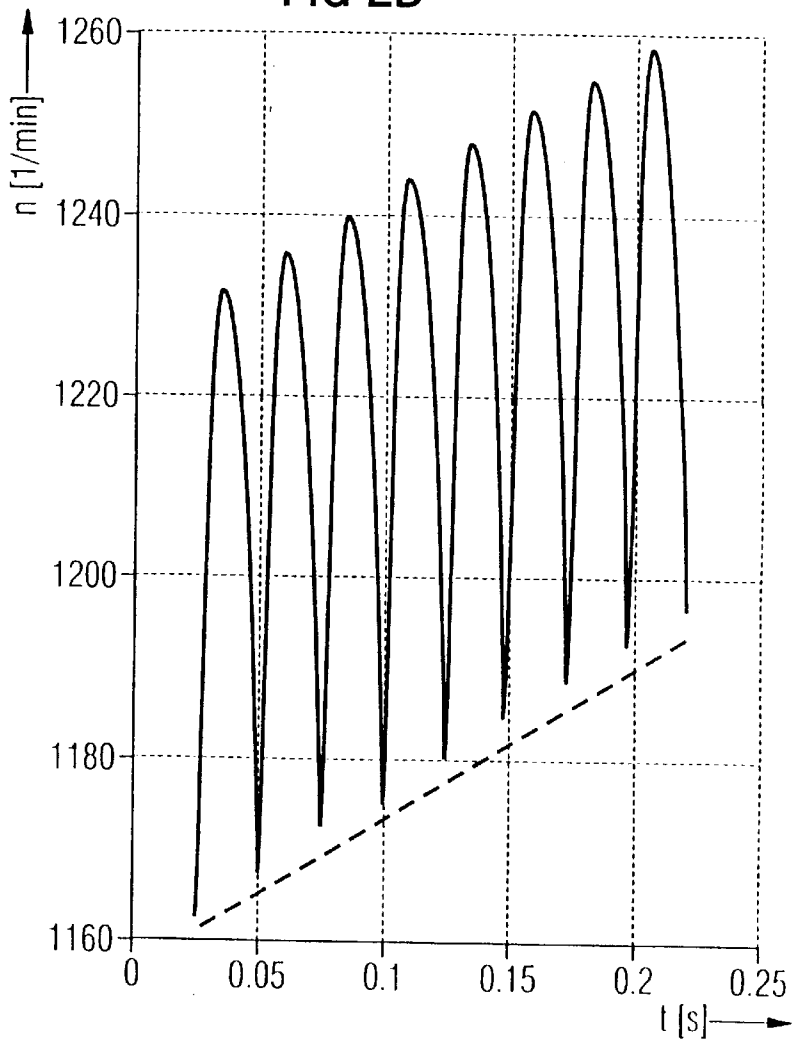
FIG. 2B is a graph plotting speed n versus time t for satisfactory injectors in nonstationary (accelerated) operation.

This problem is shown in FIG. 2. The temporal speed characteristic in FIG. 2A was simulated with the aid of satisfactory injectors in stationary operation. The above method supplies a value for the change in the kinetic energy $\Delta E_{kin}(i)=0$, that is to say no error. In FIG. 2B, the internal combustion engine was accelerated with the aid of the same satisfactory injectors. The method now calculates a value for the change in the kinetic energy $\Delta E_{kin}(i)>0$, since the speed is greater after the combustion than before, and deduces therefrom that the current injector has a positive error, that is to say is injecting too much.

A dynamic correction of the speed eliminates the limitation of a quasi-stationary operating state, and also determines an error in dynamic speed transitions. This dynamic correction is explained below with reference to the example of a 4-cylinder internal combustion engine.

The basic idea in the dynamic correction is again to take account of the tendency of the mean speed. For this purpose, it is not the actual speeds $n_{OT(i+1)}$ and $n_{OT(i)}$ that are used to determine the error, but corrected speeds $\hat{n}_{OT(i+1)}$ and $\hat{n}_{OT(i)}$.

These are free from the trend of the mean speed and therefore permit a statement on the injection response of the injector considered.

In order to determine this trend, mean speeds are calculated and related to the current values.

In order, however, to be able to compare the current speed with a mean value, the mean-value filter used must have an envelope delay of $\tau=0$. This can be achieved only with an acausal filter in which the current instant is in the middle of the averaging interval.

The averaging span should be selected in this case to be as short as possible in order quickly to detect possible changes in the speed tendency. On the other hand, however, it is necessary to average over at least one working cycle in order to eliminate the systematic errors of the injectors by calculation.

Because the internal combustion engine investigated here is a 4-cylinder internal combustion engine, four speed values (at the top dead center in each case) must be included when averaging over a working cycle. However, in order to observe the required run time of the mean-value filter of $\tau=0$, the current instant must to be in the middle of the averaging interval. However, averaging is carried out over five values since no mean value exists in the case of four speed values. The dynamic correction of the speed is therefore yielded from the acausal averaging as:

$$\bar{n}_{OT(i)}=\tfrac{1}{5}n_{OT(i-2)}+\tfrac{1}{4}n_{OT(i-1)}+\tfrac{1}{4}n_{OT(i)}\tfrac{1}{4}n_{OT(i+1)}+\tfrac{1}{5}n_{OT(i+2)} \quad (3)$$

$n_{OT(i-2)}$ and $n_{OT(i+2)}$ belong in this case to the same cylinder and are respectively rated only half as strongly as the other three values. Averaging over precisely one working cycle is thereby ensured.

The acausality can be understood by carrying out the calculation for the cylinder current at the instant i only at the end of the averaging span at the instant i+2. This is possible without difficulty because the corresponding value is not required again until in the next working cycle (i.e. at the instant i+4).

A mean value corresponding to equation (3) is also calculated for $OT_{(i+1)}$:

$$\bar{n}_{OT(i+1)}=\tfrac{1}{5}n_{OT(i-1)}+\tfrac{1}{4}n_{OT(1)}+\tfrac{1}{4}n_{OT(i+1)}+\tfrac{1}{4}n_{OT(i+2)}+\tfrac{1}{5}n_{OT(i+3)} \quad (4)$$

Figure 3:
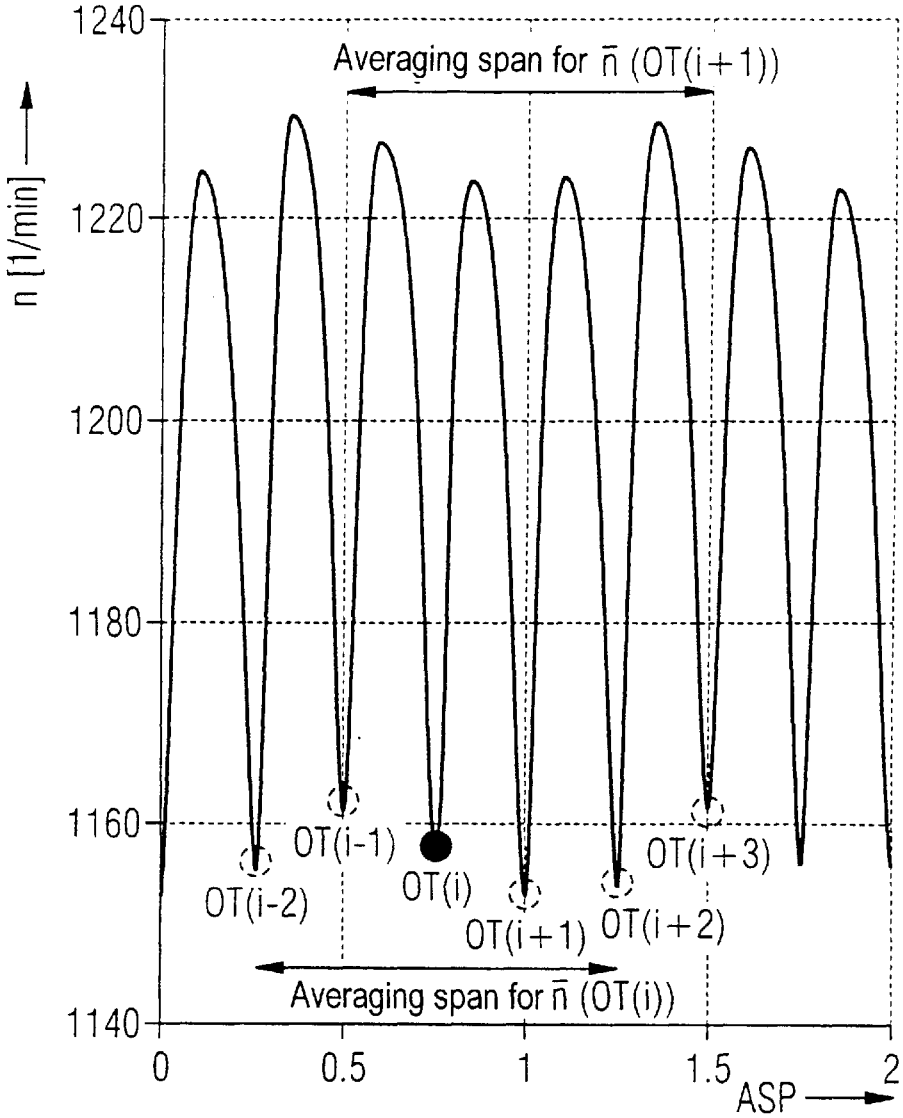
FIG. 3 shows the speed characteristic and the averaging spans for the dynamic correction.

The speed characteristic over two working cycles ASP and the averaging spans for $\bar{n}_{OT(i+1)}$ and $\bar{n}_{OT(i+1)}$ for the dynamic correction are illustrated graphically in FIG. 3.

Figure 4A:
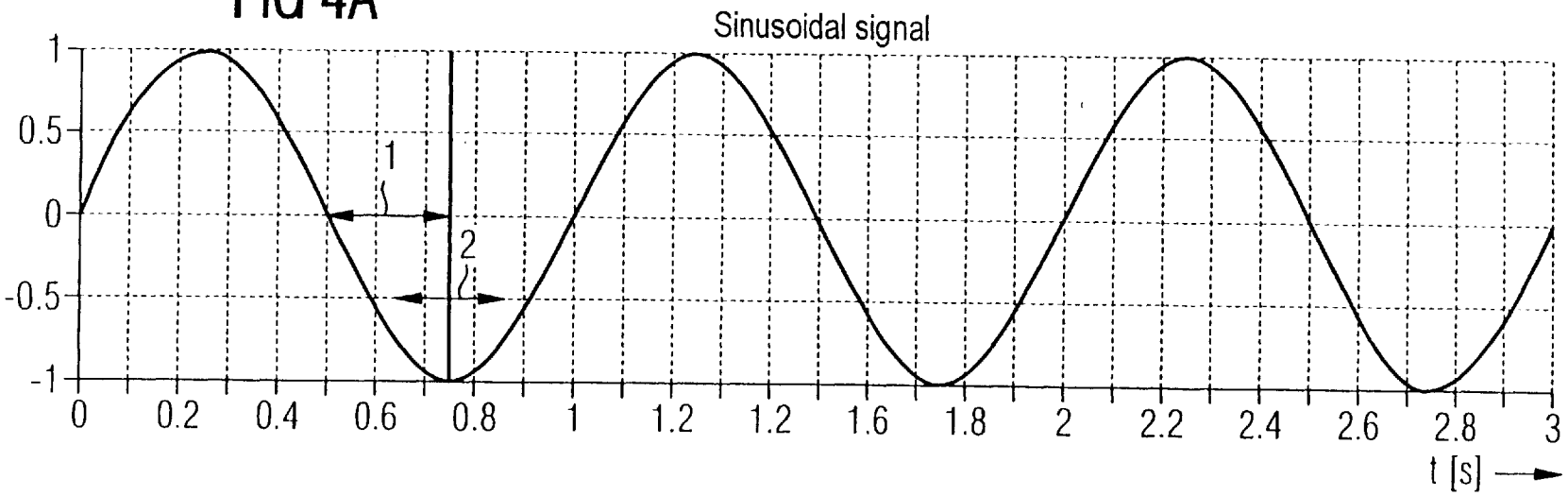
FIG. 4A is a graph illustrating the mean value characteristic relating to the run time for a sinusoidal signal.
Figure 4B:
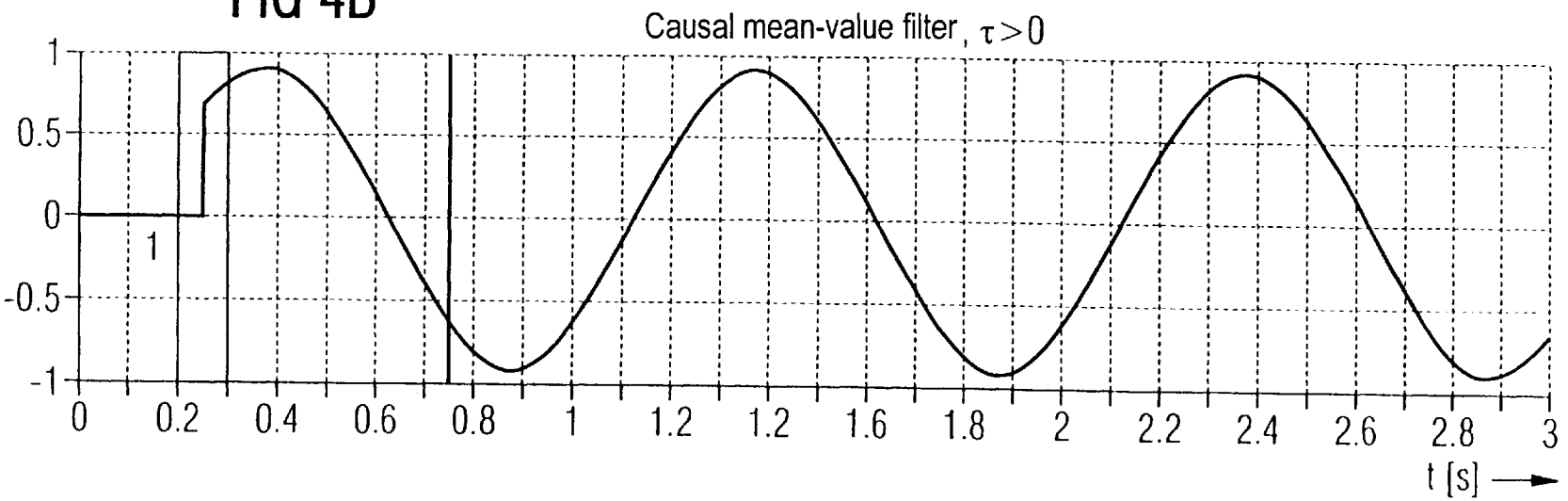
FIG. 4B is a graph illustrating the mean value characteristic relating to the use of a mean-value filter having a run time $\tau>0$.

Reference may be made to FIG. 4 in order to explain the influence of the run time $\tau$ of the mean-value filter. A sinusoidal signal is recorded in FIG. 4A. Below that (FIG. 4B) is the characteristic of the mean value for averaging over a quarter of the duration of the period in the case of the use of a classical method with the aid of a causal mean-value filter whose run time $\tau>0$. Only values from the past are used to calculate the mean value for the current instant (indicated here by a vertical straight line). A phase shift between the sinusoidal signal and the mean curve (mean value 1) is clearly to be seen.

Figure 4C:
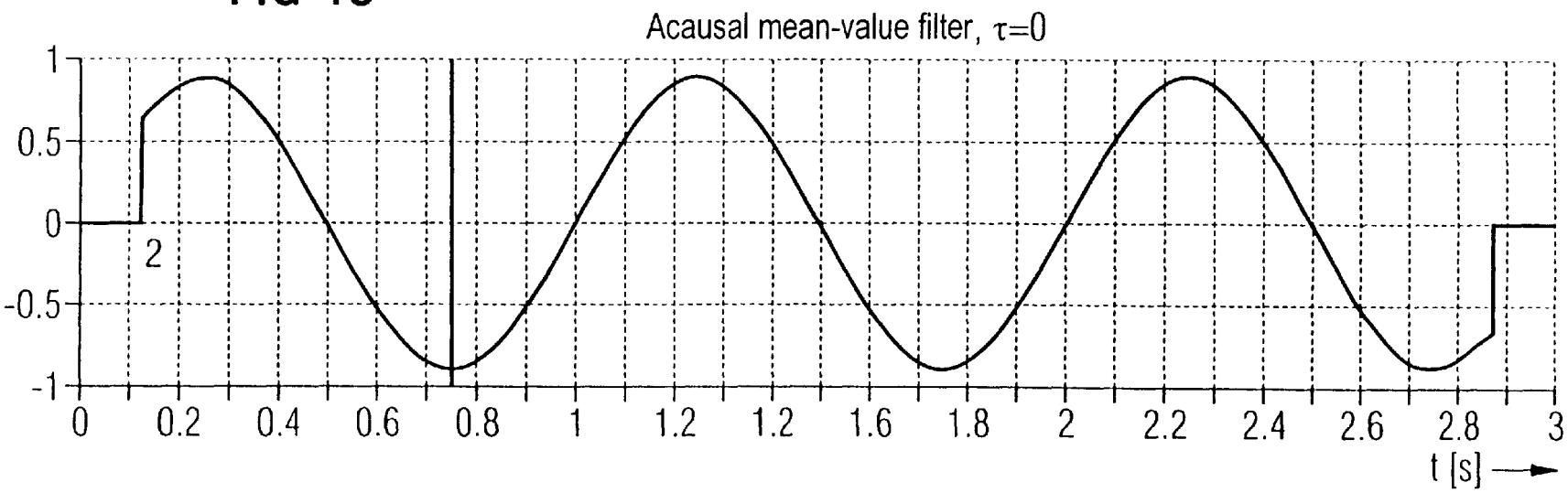
FIG. 4C is a graph illustrating the mean value characteristic relating to the use of an acausal filter having a run time $\tau=0$.

The mean value characteristic relating to the use of an acausal filter ($\tau=0$) is to be seen in FIG. 4C. The same number of values from the past and the future is used for calculation (the current instant is in the middle of the averaging interval). It is clearly to be seen here that the sinusoidal signal and the mean value signal 2 are in phase.

The corrected speeds are now calculated with the aid of the mean values from equations (3) and (4):

$$\hat{n}_{OT(i+1)} = n_{OT(i+1)} - \frac{\bar{n}_{OT(i+1)} - \bar{n}_{OT(i)}}{2} \quad (5)$$

$$\hat{n}_{OT(i)} = n_{OT(i)} - \frac{\bar{n}_{OT(i+1)} - \bar{n}_{OT(i)}}{2} \quad (6)$$

The values $n_{OT(i)}$ and $n_{OT(i+1)}$ in this case denote the values measured with the aid of the speed sensor.

Figure 5:
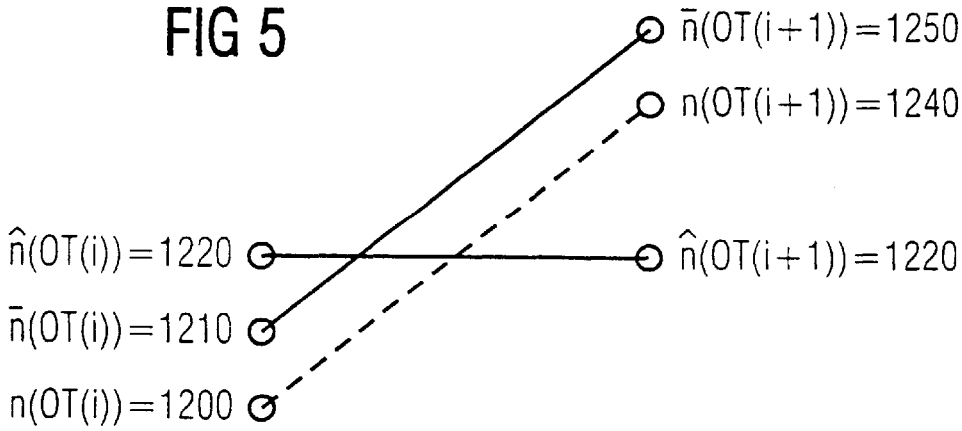
FIG. 5 shows an illustration of the dynamic correction with the aid of an acceleration process.

An example relating to the dynamic speed correction is shown in FIG. 5. Satisfactory injectors are assumed. This is to be seen in that the current speed values $n_{OT(i)}$ and $n_{OT(i+1)}$ and the associated mean values $\bar{n}_{OT(i)}$ and $\bar{n}_{OT(i+1)}$ have the same spacings (here $\Delta n=10$). The internal combustion engine is accelerated. The following are yielded:

$$\hat{n}_{OT(i)}=1220[1/\text{min}]$$

$$\hat{n}_{OT(i+1)}=1220[1/\text{min}]$$

The corrected speeds are therefore equal. The equal corrected speeds demonstrate that the injectors are operating satisfactorily. Therefore, the rising trend in the speed can be filtered out.

The corrected speed values from equations (5) and (6) are now used to calculate the change in the kinetic energy ($\Delta E_{kin,z(i)}$) for the cylinder Z(i) in accordance with the following equation:

$$\Delta E_{kin}(i)=\tfrac{1}{2}\cdot\Theta\cdot(\hat{n}_{OT(i+1)}^2-\hat{n}_{OT(i)}^2)$$

and a residue is calculated therefrom as $$R_{Z(i)}=K_{norm}\cdot(\hat{n}_{OT(k,i+1)}^2-\hat{n}_{OT(k,i)}^2) \quad (7)$$

where $$K_{norm} = \frac{\frac{1}{2}\cdot\theta\cdot\left(\frac{2\pi}{60}\right)^2}{H_u\cdot m_{B\max}}\cdot 100 \quad (8)$$

and $R_Z(i)$ is the residue of the cylinder Z(i), $\Theta$ is the mean moment of inertia of the crankshaft (applied), $H_u$ is the lower calorific value for the fuel used, $m_{Bmax}$ is the maximum injectable fuel quantity, $\hat{n}_{OT(i)}$ is the corrected speed at the top dead center of the cylinder i, $\hat{n}_{OT(i+1)}$ is the corrected speed at the top dead center of the cylinder i+1, and $K_{norm}$ is the normalizing factor which, given appropriate normalization, contains a statement on the percentage of fuel overinjected or underinjected.

In the equation (8), the factor $$\frac{2\pi}{60}$$

serves to convert from revolutions per minute (unit of n) into radians per second (unit of ω). Multiplication by ½·θ produces an energy difference that corresponds to that in equation (2). Division by $H_u \cdot m_{B\ max}$ and multiplication by 100 yield a percentage error, since the difference in kinetic energy which occurs owing to injector errors during an ignition is related to the overall energy of the injected fuel quantity $m_B$.

Figure 6:
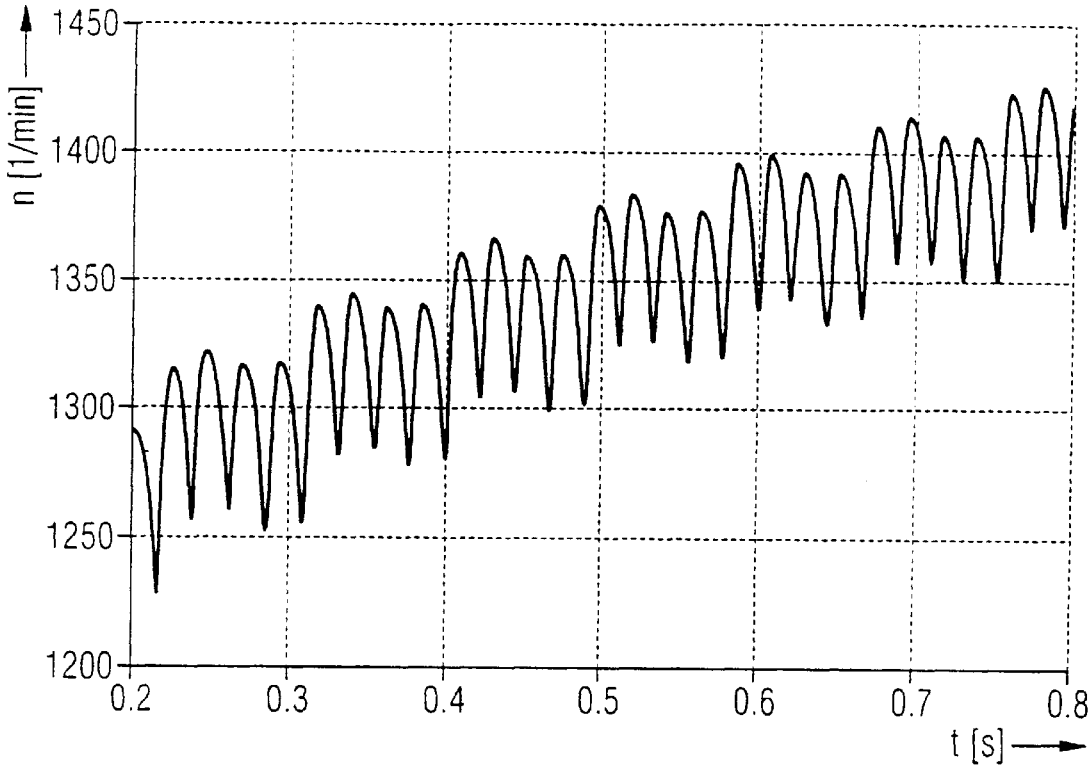
FIG. 6 shows the speed and residue characteristics in the case of gentle acceleration of the internal combustion engine.
Figure 6:
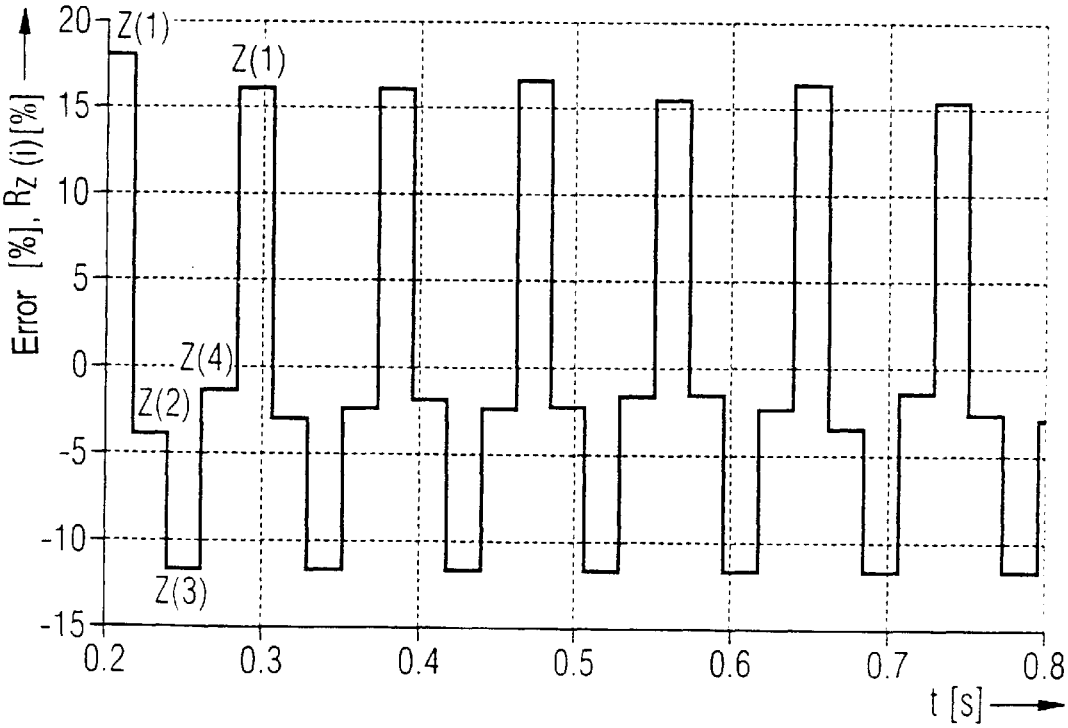

FIG. 6 shows a speed characteristic for gentle acceleration of the internal combustion engine, in the case of which a larger quantity of injected fuel was prescribed by cylinder Z(1). The lower illustration in FIG. 6 shows that despite a rise in speed the cylinder-specific residues, equivalent to the errors, remain equal because of the specified dynamic correction. Each fourth value belongs to the same cylinder i. Therefore, the error patterns remain the same.

Pro rata injection corrections can now be undertaken from the cylinder-specific residues obtained using this method. Since the residues represent only relative measures for the change in the quantity of fuel to be injected, the adaptation algorithm is also set up with reference to this aspect. At no instant of correction can the internal combustion engine contain more or less fuel than in the uncorrected case. The algorithm is therefore to undertake only the task of uniform distribution of the injection quantity. The adaptation algorithm for a 4-cylinder internal combustion engine is therefore yielded as $$\begin{bmatrix} \delta_{Z(1),k} \\ \delta_{Z(2),k} \\ \delta_{Z(3),k} \\ \delta_{Z(4),k} \end{bmatrix} = \begin{bmatrix} \delta_{Z(1),k-1} \\ \delta_{Z(2),k-1} \\ \delta_{Z(3),k-1} \\ \delta_{Z(4),k-1} \end{bmatrix} + \alpha \cdot \left[ - \begin{pmatrix} R_{Z(1),k} \\ R_{Z(2),k} \\ R_{Z(3),k} \\ R_{Z(4),k} \end{pmatrix} + \frac{1}{3} \cdot \begin{pmatrix} R_{Z(2),k} + R_{Z(3),k} + R_{Z(4),k} \\ R_{Z(3),k} + R_{Z(4),k} + R_{Z(1),k} \\ R_{Z(4),k} + R_{Z(1),k} + R_{Z(2),k} \\ R_{Z(1),k} + R_{Z(2),k} + RZ_{(3),k} \end{pmatrix} \right]$$

$$\text{With} \begin{bmatrix} \delta_{Z(1),0} \\ \delta_{Z(2),0} \\ \delta_{Z(3),0} \\ \delta_{Z(4),0} \end{bmatrix} = \begin{bmatrix} 1 \\ 1 \\ 1 \\ 1 \end{bmatrix}$$

as initialization value for a case of multiplicative adaptation.

In the above, $\delta_{Z(i),k}$ is the correction term for cylinder i after adaptation step k, $R_{Z(i),k}$ is the residue of the cylinder i relative to the adaptation step k, and α is a positive, freely selectable adaptation parameter between 0 and 1 which fixes the rate of the adaptation.

If more fuel is injected in a cylinder, this fuel quantity is subtracted pro rata for the other cylinders. A positive residue of the cylinder indicates that more fuel is injected. Subtracted pro rata means to the extent of one third in each case for 4-cylinder internal combustion engine, and more generally 1/(z−1) for a z-cylinder internal combustion engine.

If less fuel is injected in a cylinder (i.e., the residue of the cylinder was negative), this fuel quantity is added pro rata for the other cylinders.

This ensures that the torque remains constant during the cylinder equalization, because the fuel quantity to be fed does not change overall.

The sum of the correction terms is equal at every instant to the number of cylinders.

Only a single controlled variable, specifically the injection period $T_E$, is available for correcting the injection quantity $m_{B,i}$ in a cylinder. Because of the always positive gradient of an inverted nozzle characteristic (injection quantity and as a function of injection period), longer driving entails a larger injection quantity. Therefore, the injection correction can be performed directly via the injection period by multiplying the correction terms $\delta_{Z(i)}$,k from the adaptation algorithm by the ideal injection times $T_{E,ideal}$ prescribed by the engine management.

We claim:

1. A method for cylinder equalization, which comprises:

providing an internal combustion engine having a crank shaft and cylinders operating by direct injection, each cylinder having a fuel injection quantity;

detecting a speed value of the crankshaft in a quasi-stationary and in a dynamic operating state of the internal combustion engine;

correcting the speed values with a mean-value filter having an envelope delay of zero to form a corrected speed value;

calculating a change in the kinetic energy of the crankshaft in an expansion interval of a cylinder from the corrected speed value;

deriving from the change in kinetic energy of the crankshaft a relative measure for each cylinder that contains information on too much or too little injected fuel quantity;

calculating correction terms for the injection time from this measure; and changing each cylinder-specific injection time by applying a respective cylinder-specific correction term so that the internal combustion engine runs more smoothly.

2. The method according to claim 1, wherein the correction of the speed values is performed according to the following relationship:

$$\hat{n}_{OT(i+1)} = n_{OT(i+1)} - \frac{\bar{n}_{OT(i+1)} - \bar{n}_{OT(i)}}{2}$$

$$\hat{n}_{OT(i)} = n_{OT(i)} - \frac{\bar{n}_{OT(i+1)} - \bar{n}_{OT(i)}}{2}$$

where $\hat{n}_{OT(i)}$, $\hat{n}_{OT(i+1)}$ is the corrected speed of the cylinder i and i+1, respectively, over a working cycle, and $\bar{n}_{OT(i)}$, $\bar{n}_{OT(i+1)}$ is the mean value of the speed of the cylinder i and i+1, respectively, over a working cycle.

3. The method according to claim 2, wherein the internal combustion engine is a 4-cylinder internal combustion engine and the mean value of the cylinder is calculated as:

$$\bar{n}_{OT(i)} = \tfrac{1}{8} n_{OT(i-2)} + \tfrac{1}{4} n_{OT(i-1)} + \tfrac{1}{4} n_{OT(i)} + \tfrac{1}{4} n_{OT(i+1)} + \tfrac{1}{8} n_{OT(i+2)}.$$

4. The method according to claim 2, wherein the internal combustion engine is a 4-cylinder internal combustion engine and the mean value of the cylinder is calculated as:

$$\bar{n}_{OT(i+1)} = \tfrac{1}{8} n_{OT(i-1)} + \tfrac{1}{4} n_{OT(1)} + \tfrac{1}{4} n_{OT(i+1)} + \tfrac{1}{4} n_{OT(i+}2) + \tfrac{1}{8} n_{OT(i+}3).$$

5. The method according to claim 1, wherein the change in the kinetic energy are referred to a value which specifies a maximum fuel energy which can be fed in an interval, and the relative measure is calculated therefrom.

6. The method according to claim 1, wherein the change in the kinetic energy is calculated in accordance with the following equation $$\Delta E_{kin}(i)=\tfrac{1}{2}\cdot\theta\cdot(\hat{n}_{OT(i+1)}-\hat{n}_{OT(i)}^{2})$$

and the measure is determined therefrom as $$R_{Z(i)}K_{norm}\cdot(\hat{n}_{OT(k,i+1)}^{2}-\hat{n}_{OT(k,i)})$$

where $\theta$ is the mean moment of inertia of the crankshaft, $H_u$ is the lower calorific value for the fuel used, $m_{Bmax}$ is the maximum injectable fuel quantity, $\hat{n}_{OT(i)}$ is the corrected speed at the top dead center of the cylinder i, $\hat{n}_{OT(i+1)}$ is the corrected speed at the top dead center of the cylinder i+1, and $K_{norm}$ is a normalizing factor which has the value of $$\frac{\theta}{2}\cdot\frac{1}{H_u m_{B\max}}\left(\frac{2\pi}{60}\right)^2.$$

7. The method according to claim 1, wherein the correction terms by which the values for the injection times are multiplied are calculated from the calculated measures.

8. The method according to claim 7, wherein the correction terms are calculated as $$\begin{bmatrix}\delta_{Z(1),k}\\ \delta_{Z(2),k}\\ \delta_{Z(3),k}\\ \delta_{Z(4),k}\end{bmatrix}=\begin{bmatrix}\delta_{Z(1),k-1}\\ \delta_{Z(2),k-1}\\ \delta_{Z(3),k-1}\\ \delta_{Z(4),k-1}\end{bmatrix}+\alpha\cdot\left[-\begin{pmatrix}R_{Z(1),k}\\ R_{Z(2),k}\\ R_{Z(3),k}\\ R_{Z(4),k}\end{pmatrix}+\frac{1}{3}\cdot\begin{pmatrix}R_{Z(2),k}+R_{Z(3),k}+R_{Z(4),k}\\ R_{Z(3),k}+R_{Z(4),k}+R_{Z(1),k}\\ R_{Z(4),k}+R_{Z(1),k}+R_{Z(2),k}\\ R_{Z(1),k}+R_{Z(2),k}+RZ_{(3),k}\end{pmatrix}\right]$$

$$\text{with}\begin{bmatrix}\cdot\cdot_{Z(1),0}\\ \cdot\cdot_{Z(2),0}\\ \cdot\cdot_{Z(3),0}\\ \cdot\cdot_{Z(4),0}\end{bmatrix}=\begin{bmatrix}1\\ 1\\ 1\\ 1\end{bmatrix}$$

as an initialization value, and where $\delta_{Z(i),k}$ is the correction term for cylinder i after adaptation step k, $R_{Z(i),k}$ is a residue of the cylinder i relative to the adaptation step k, and $\alpha$ is a positive, freely selectable adaptation parameter between 0 and 1 which fixes the rate of the adaptation.

* * * * *